US007942555B2

(12) United States Patent
Hadden

(10) Patent No.: US 7,942,555 B2
(45) Date of Patent: May 17, 2011

(54) MULTI-ACTION, BATTERY-POWERED, TRIGGER-ACTIVATED LIGHTING SYSTEM

(75) Inventor: David M. Hadden, Los Altos, CA (US)

(73) Assignee: Arlo, Incorporated, Los Altos, CA (US)

( * ) Notice: Subject to any disclaimer, the term of this patent is extended or adjusted under 35 U.S.C. 154(b) by 241 days.

(21) Appl. No.: 12/350,887

(22) Filed: Jan. 8, 2009

(65) Prior Publication Data

US 2009/0180280 A1 Jul. 16, 2009

Related U.S. Application Data

(60) Provisional application No. 61/010,771, filed on Jan. 11, 2008.

(51) Int. Cl.
*F21V 23/04* (2006.01)

(52) U.S. Cl. ..... 362/276; 362/802

(58) Field of Classification Search ..... 362/276, 362/205, 802

See application file for complete search history.

(56) References Cited

U.S. PATENT DOCUMENTS

| | | | | |
|---|---|---|---|---|
| 2,517,119 | A * | 8/1950 | Le Due | 340/473 |
| 5,412,548 | A * | 5/1995 | Yee | 362/202 |
| 5,565,844 | A * | 10/1996 | Bedrosian | 340/567 |
| 5,763,872 | A | 6/1998 | Ness | |
| 6,280,053 | B1 * | 8/2001 | Chien | 362/228 |
| 7,410,271 | B1 * | 8/2008 | Man | 362/184 |
| 2005/0237734 | A1 * | 10/2005 | Krieger | 362/157 |
| 2007/0014105 | A1 * | 1/2007 | Noguchi et al. | 362/183 |
| 2008/0043471 | A1 * | 2/2008 | Musgrove et al. | 362/276 |
| 2008/0079568 | A1 | 4/2008 | Primous et al. | |
| 2008/0290170 | A1 | 11/2008 | Blake et al. | |

* cited by examiner

*Primary Examiner* — Robert May

(74) *Attorney, Agent, or Firm* — Michael A. Glenn; Glenn Patent Group

(57) ABSTRACT

A multi-action, battery-powered, trigger-activated lighting system automatically provides soft light upon human motion during the night, even in the event of a power outage, and can additionally be deployed quickly for use as an intense flashlight. Furthermore, it can provide low-battery indication to prompt the user to install fresh batteries whenever necessary, before a critical need arises.

9 Claims, 3 Drawing Sheets

MULTI-ACTION, BATTERY-POWERED, TRIGGER-ACTIVATED LIGHTING SYSTEM

CROSS REFERENCE TO RELATED APPLICATIONS

This application claims priority to U.S. provisional patent application Ser. No. 61/010,771, filed 11 Jan. 2008, which application is incorporated herein in its entirety by this reference thereto.

BACKGROUND OF THE INVENTION

1. Technical Field

The invention relates to lighting systems. More particularly, the invention relates to a multi-action, battery-powered, trigger-activated lighting system.

2. Description of the Prior Art

For various reasons, people sometimes need to rise from sleep during the night. In such circumstances, it is desirable to have sufficient lighting to support accident-free mobility. For this purpose, some people employ always-on nightlights that operate from mains power. Others use nightlights that incorporate a sensor so as to provide automatic illumination only when there is a warm body in motion near the nightlight. Still others simply rely on a flashlight, or torch as it is also called in some English-speaking countries, that is kept near the bed for nighttime use. Such a flashlight may provide better portability and light intensity than a typical nightlight, and thus be useful in power outages or other emergencies.

Each of these nighttime lighting solutions has certain limitations. For example, the mains-operated type does not function in the event of a power outage. The standard automatic nightlight may not supply a sufficiently intense light for more critical nighttime tasks, such as may arise during a power outage or a burglary. The flashlight near the bed may have weak or dead batteries, of which no one may be aware until a time of need.

It would be advantageous to provide improvements to address these limitations.

SUMMARY OF THE INVENTION

A presently preferred embodiment of the invention provides a multi-action, battery-powered, trigger-activated lighting system that can automatically provide soft light upon human motion during the night, even in the event of a power outage, and that can additionally be deployed quickly for use as an intense flashlight. Furthermore, it can provide a low-battery indication to prompt the user to install fresh batteries whenever necessary, before a critical need arises.

DETAILED DESCRIPTION OF THE INVENTION

A lighting system according to a presently preferred embodiment of this invention has any of several modes of operation, including, but not limited to, those described below:

OFF Mode

To conserve battery life, an embodiment has a user-control means for complete disconnection of its circuits from its battery.

QUIESCENT Mode

In this mode, the system's trigger-activation means is enabled. It draws very little current from the system's battery, so that the system may be operated in this mode indefinitely. The amount of current drawn may be so low as to make unnecessary any battery disconnection means. The system may employ an ambient light sensing means to disable the trigger-activation means whenever sufficient light is present to render unnecessary any of the system's active lighting modes.

FIRST ACTIVE Lighting Mode

In response to a first signal from the trigger-activation means, the system activates a first lighting means.

SECOND ACTIVE Lighting Mode

A second lighting means may be activated by any one of several means:

1) a second signal from the trigger-activation means;
2) a first signal from a user-control means; or
3) a first signal from a sensing means.

Example of the Invention

Figure 1A:
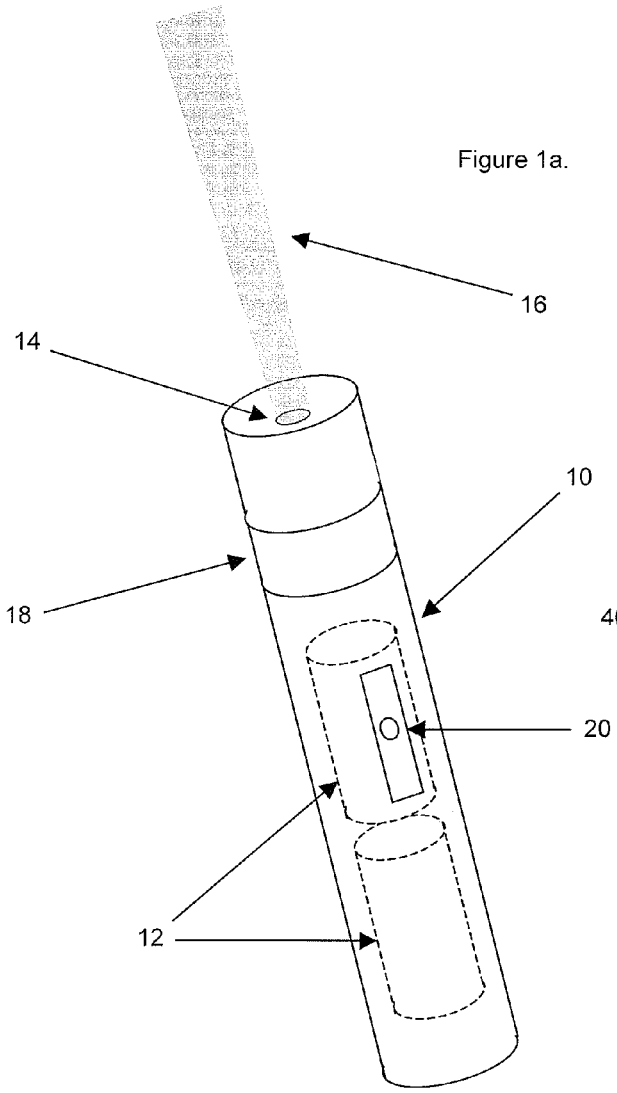
FIGS. 1*a* and 1*b* are perspective views of a lighting system according to an embodiment of the invention.

As a non-limiting example, shown in FIG. 1*a*, a system according to the invention is embodied in a housing 10 resembling that of a flashlight. That is, an embodiment of the invention comprises an essentially cylindrical housing enclosing batteries 12 and providing one or more light sources 14 emitting light 16 away from the housing along its cylindrical axis, and/or other light sources emitting light into a larger spherical angle, for example, by passing through the housing 10, if it is made of translucent or transparent material. The system also comprises a sensor window 18 and a user control 20 for activating different operational modes.

Figure 2:
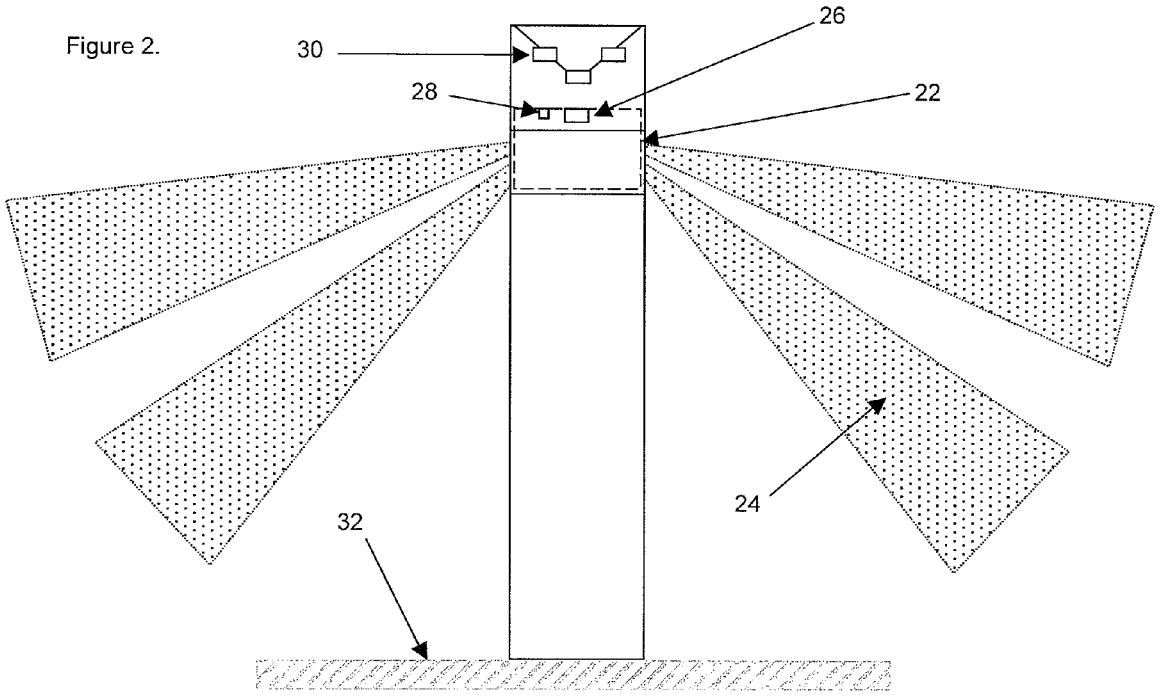
FIG. 2 is a sectional side view of a lighting system according to an embodiment of the invention.

As shown in the sectional side view of FIG. 2, an embodiment of the invention contains optical elements, such as lenses and/or mirrors, etc., within the volume outlined by dashed lines 22 inside the sensor window 18. The optical elements direct infrared (IR) light from various fields-of-view 24 onto an IR detector 26, so that IR light from moving warm bodies, e.g. humans, can be converted to an electrical signal and used to create a first signal as a means for triggering the sensor's FIRST ACTIVE lighting mode, such as activating the light source 14. An embodiment of the invention provides an ambient light sensor 28 that produces an electrical signal in response to ambient light level. This signal disables the trigger-activation means whenever sufficient light is present, and thus renders unnecessary any of the system's active lighting modes.

For example, a user operates the control 20 to change the system from OFF mode to QUIESCENT mode, sets the system in a vertical position on a surface 32, for example a dresser or night table, with the light source 14 facing the ceiling, and then goes to sleep. During the night, were the user to rise and pass through one of the fields-of-view 24, the user's IR light causes an electrical signal in the detector, which is employed within the system to trigger the system's FIRST ACTIVE mode, such as activating the light source 14, which provides indirect light via the ceiling, which is sufficient for the user to navigate through the room.

In cases where the soft indirect light is not sufficient, the user operates the control 20 to change the system from FIRST ACTIVE mode to SECOND ACTIVE mode. For example, secondary light source(s) 30 are activated so that the system provides brighter light. The user either leaves the system in place facing the ceiling, or takes the system in hand and uses it as a flashlight. As a system design alternative to requiring the user to employ the control 20 to change the mode, a tilt switch is provided instead, which automatically changes the system from FIRST ACTIVE mode to SECOND ACTIVE mode as soon as the system is taken in hand and moved more than a few degrees away from a vertical orientation.

As an indication of low-battery state, the system, for example, emits several pulses of light at the time of mode changes to alert the user to replace the system's batteries soon, yet while allowing normal use of the system after the pulses.

Figure 3:
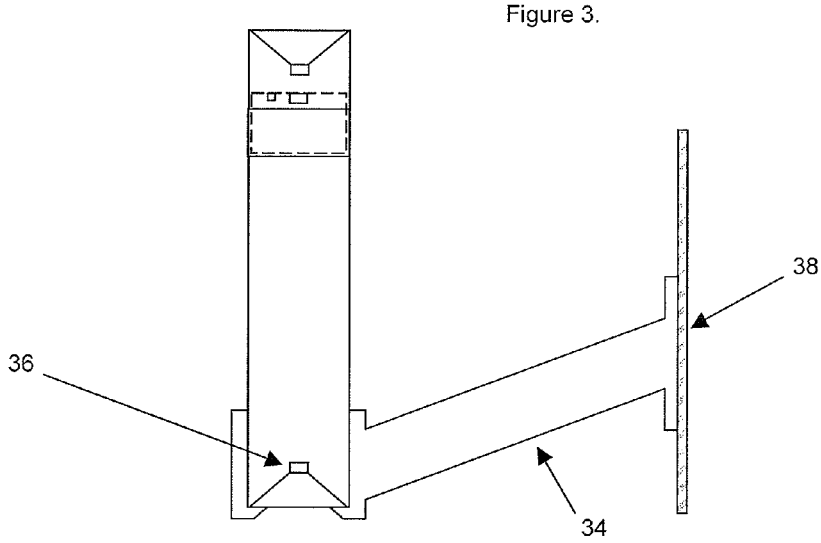
FIG. 3 is a sectional side view of a lighting system according to an alternative embodiment of the invention.

As an alternative to the system being set on a horizontal plane such as the surface 32, it is placed into a holder such as a candle-sconce 34 mounted on wall 38, as shown in the sectional side view of FIG. 3. For a system that provides floor lighting, an embodiment of the sconce 34 is constructed with a hole 36 under the system, and the system is fitted with a light source 36 emitting light 16 away from the housing along its cylindrical axis, and toward the floor.

Figure 4:
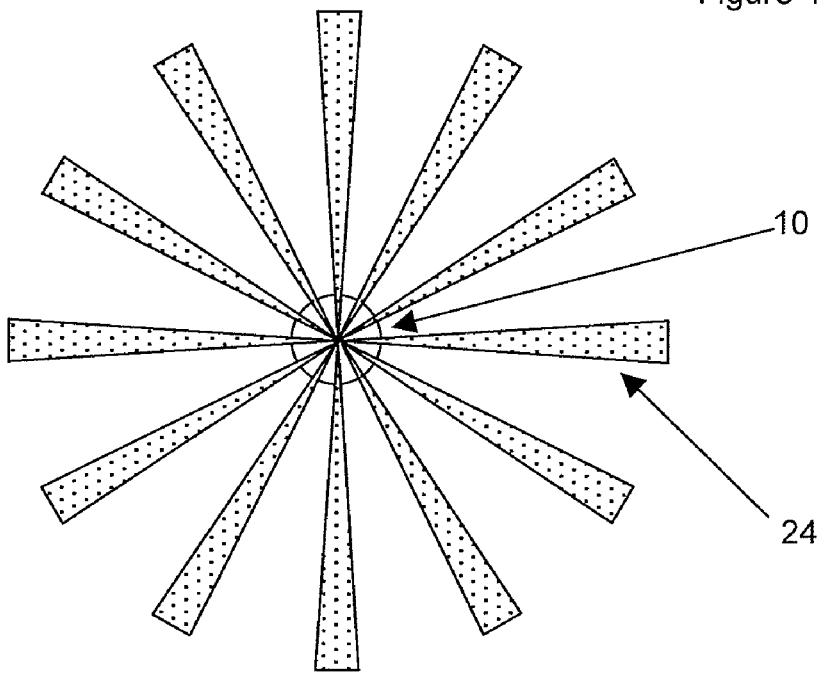
FIG. 4 is a plan view of an example of detector/optics-generated fields-of-view according to an embodiment of the invention.

Viewed from a top perspective, i.e. along the axis of the system's housing 10, the plan view of an example of detector/optics-generated fields-of-view 24 is shown in FIG. 4. Depending on the system's detector and electronic signal processing, at distances of several meters or more from the system, moving humans crossing the fields-of-view are detected by the system, and to cause it to change from QUIESCENT mode to FIRST ACTIVE lighting mode.

Figure 5:
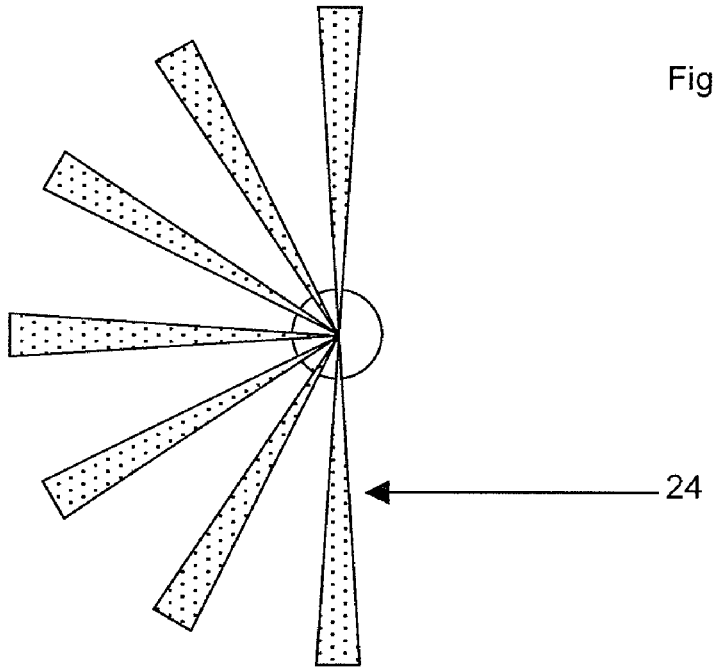
FIG. 5 is a plan view of an example of detecting through an angle less than 360 degrees according to an alternative embodiment of the invention.

If it is not desirable for the system to detect in all directions, then it can be designed to detect through an angle less than 360 degrees, as shown in FIG. 5. Alternately, a 360-degree system can be provided with a mask to adjust its detection angle.

Figure 1B:
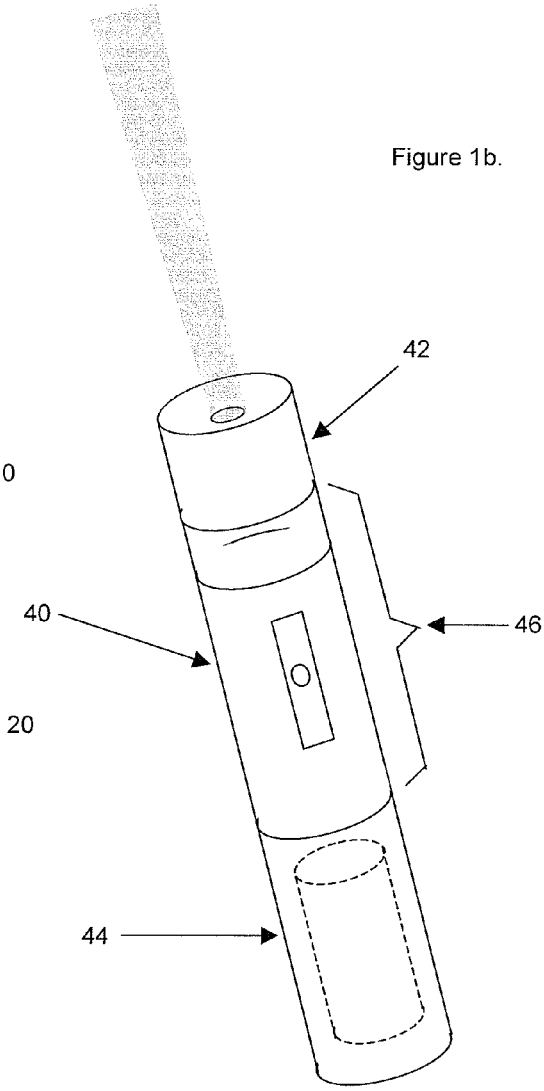

As an alternative to the integrated system already discussed, the invention may also be realized in modular fashion. FIG. 1*b* is a perspective view of a system 40 according to the invention is embodied in a form factor that resembles that of a flashlight, similar to the system 10 of FIG. 1*a*. The modular system 40 comprises a lamp module 42, a battery module 44, and a control module 46, which may comprise an IR detector, an ambient light sensor, a sensor window, a user control, and so forth, as previously discussed. The modular system may be assembled as a simple flashlight by omitting the control module 46, or as a complete system according to the invention by including the control module 46. The modules may be retrofitted to a standard flashlight by removing the light bulb from the flashlight, inserting the module into the flashlight's light bulb socket, and then inserting the flashlight's bulb into a socket in the module. The module is thus placed in-line between the flashlight's bulb and the socket. In other embodiments, the module may be inserted into the battery compartment in place of a battery, or it may be joined into the flashlight's existing structure, for example by screwing the module onto a bottom cap of the flashlight.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A lighting system, comprising:

a flashlight housing containing a lamp module, a battery module, and a control module;

said lamp module comprising only a single light source;

said battery module comprising at least one battery for powering said at source;

said light source arranged for emitting light away from said housing when said light source is activated;

said control module comprising:

a trigger-activation means associated with said housing for operating said light source upon the occurrence of an activation event;

a sensor associated with said housing, for detecting an activation event and for operating said trigger-activation means in response thereto; and a user control for activating any of a plurality of operational modes, said operational modes comprising any of:

an OFF mode for disconnecting said light source from said at least one battery;

a QUIESCENT mode for enabling said trigger-activation means;

a FIRST ACTIVE lighting mode for activating said light source at a first intensity level in response to a first signal from said trigger-activation means; and a SECOND ACTIVE lighting mode for activating said a light source at a second intensity level by any one of:

a second signal from said trigger-activation means;

a first signal from said user control; and a first signal from said sensor.

2. The lighting system of claim 1, wherein said housing is made of translucent or transparent material and adapted to pass light from said light source therethrough.

3. The lighting system of claim 1, further comprising:

an ambient light sensing means for disabling said trigger-activation means whenever sufficient light is present to render activation of said light source unnecessary.

4. The lighting system of claim 1, said sensor further comprising:

an infrared (IR) light detector; and one or more optical elements for directing IR light from any of a plurality of fields-of-view onto said IR detector to convert IR light from moving persons proximate to said lighting system into an electrical signal for triggering said FIRST ACTIVE lighting mode.

5. The lighting system of claim 4, said one or more optical elements further comprising:

a mask for adjusting a detection angle within a range of up to 360-degrees.

6. The lighting system of claim 1, further comprising:

a tilt switch for automatically changing said lighting system from said FIRST ACTIVE mode to said SECOND ACTIVE mode when the housing is taken in hand by a user and moved more than a few degrees away from a vertical orientation.

7. The lighting system of claim 1, further comprising:

an indicator for identifying a low-battery state.

8. The lighting system of claim 1, further comprising:

a holder formed to removably receive said housing and adapted to be mounted on a wall.

9. The lighting system of claim 8, said holder further comprising an aperture positioned coincident with light source associated with said housing facing downward for emitting light downwardly away from said housing.

* * * * *